US011279545B1

(12) United States Patent
Tarrant

(10) Patent No.: US 11,279,545 B1
(45) Date of Patent: Mar. 22, 2022

(54) CONTAINER-CLOSURE SYSTEM

(71) Applicant: ELC Management LLC, Melville, NY (US)

(72) Inventor: Philip Andrew Tarrant, Glen Rock, NJ (US)

(73) Assignee: ELC Management LLC, Melville, NY (US)

( * ) Notice: Subject to any disclaimer, the term of this patent is extended or adjusted under 35 U.S.C. 154(b) by 18 days.

(21) Appl. No.: 17/021,483

(22) Filed: Sep. 15, 2020

(51) Int. Cl.
*B65D 81/32* (2006.01)
*A45D 40/24* (2006.01)
*B65D 51/22* (2006.01)

(52) U.S. Cl.
CPC ..... *B65D 81/3211* (2013.01); *A45D 40/24* (2013.01); *B65D 51/22* (2013.01); *A45D 2200/058* (2013.01)

(58) Field of Classification Search
CPC ..... B65D 51/2807; B65D 81/3205; B65D 81/3222; B65D 81/32
USPC ..... 206/221, 219
See application file for complete search history.

(56) References Cited

U.S. PATENT DOCUMENTS 3,924,741 A * 12/1975 Kachur ..... B65D 51/2892 206/221
6,921,087 B2 * 7/2005 Takahashi ..... B65D 51/2878 277/628
8,376,175 B2 * 2/2013 Gonzalez ..... B65D 51/2864 220/254.8
2013/0306499 A1 * 11/2013 Lee ..... B65D 47/243 206/221
2014/0166510 A1 * 6/2014 Frutin ..... B65D 83/00 206/221
2015/0266634 A1 * 9/2015 Yang ..... B65D 51/2892 206/221

* cited by examiner

*Primary Examiner* — Steven A. Reynolds
(74) *Attorney, Agent, or Firm* — Peter Giancana

(57) ABSTRACT

A container-closure system comprises a threaded-neck container that houses a first flowable product in a first reservoir. A threaded closure assembly for the container initially houses a second flowable product in a second reservoir, and comprises an inner cap and an overcap. Movement of the overcap with respect to the inner cap effects the mixing of the two flowable products in the first reservoir.

11 Claims, 14 Drawing Sheets

CONTAINER-CLOSURE SYSTEM

FIELD OF THE INVENTION

The invention is in the field of packaging for consumer products, such as found in the cosmetic and personal care industry. More specifically, the invention pertains to packaging that is able to keep multiple ingredients and/or compositions separated until they are mixed at the time of use.

BACKGROUND

One of the problems that formulators sometimes face is the use of ingredients whose efficacy or potency decreases with time. Thus, the time from filling a container until the first use by the consumer, represents a loss of efficacy or potency. To compensate for this, a formulator may include more of the ingredient than is really needed by the consumer. For example, a particular enzyme may slowly breakdown in the composition. To ensure that there is an efficacious amount of the enzyme by the time the consumer uses the product, extra enzyme may be put into the composition. This is an obvious disadvantage, as the enzyme may be expensive or the degraded enzyme may further disturb the chemical composition. Thus, it would be advantageous if the enzyme could be protected from degradation until the time of first use by the consumer. Furthermore, a formulator may wish to include in the composition, one or more ingredients that are reactive with the composition for some beneficial purpose. However, in some situations, it may be advantageous to delay that reaction until the time of first use by a consumer. That is not possible with a conventional, single compartment container.

In the cosmetic and personal care industry, packaging that is able to keep multiple ingredients and/or compositions separated are known. For example, U.S. Pat. No. 8,087,842 discloses a multi-compartment, wiper-applicator package that comprises a container holding a first formulation, a wiper that is initially sealed at both ends, and a barbed tool. Within the sealed wiper is a quantity of secondary ingredients that is to be mixed with the first formulation in the container. The barbed tool is able to pierce the top seal, and then dislocate the bottom seal to allow the secondary ingredients to fall into the first formulation for mixing therewith.

WO2018/118845 discloses a fresh composition delivery system includes a package with two compartments separated by a foil seal for separating a cosmetically acceptable carrier from an unstable active ingredient. At the bottom of the container, an elastomeric bulb with a dart can be actuated by the user to pierce the foil seal so that the carrier and the active can be mixed in the package to form a composition shortly before use.

U.S. Pat. No. 10,661,968 discloses a container system for mixing and dispensing that comprises two containers, each container holding one or more ingredients. A first container is sealed with a frangible seal. A second container is sealed with a reusable cap and closure. At the time of use, the containers are able to be joined in a way that creates a passageway from one container to the other, which allows the ingredients in each container to mix. When the containers are separated, the first container is empty, and the second container holds the mixed ingredients. The second container can be fitted with the reusable cap closure to seal off the mixed ingredients from the ambient environment.

OBJECT OF THE INVENTION

To provide a single container and single closure system that is able to prevent multiple ingredients and/or compositions from mixing until the time of first use, while being very easy to use.

SUMMARY

A container-closure system according to the present invention comprises an ordinary threaded-neck container that houses a first flowable product. A threaded closure assembly for the container initially houses a second flowable product. The closure assembly comprises an inner cap and an overcap, and may be ordinary in external appearance. However, movement of the overcap with respect to the inner cap effects the mixing of the two flowable products in the container.

DETAILED DESCRIPTION

The term "comprises" and its variants means that a list of elements is not necessarily limited to those explicitly recited.

Figure 1:
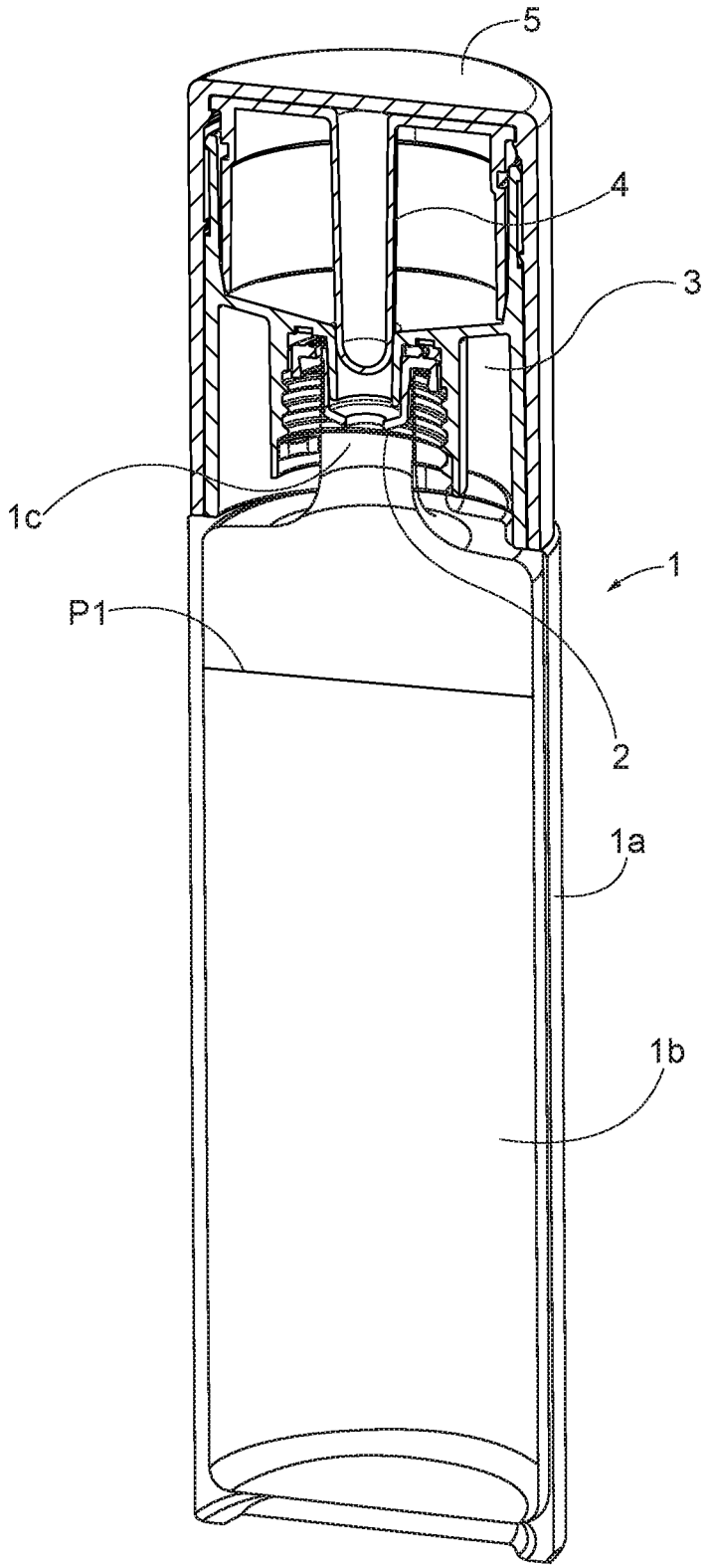
FIG. 1 is a cross section of a container-closure system according to the invention.
Figure 2:
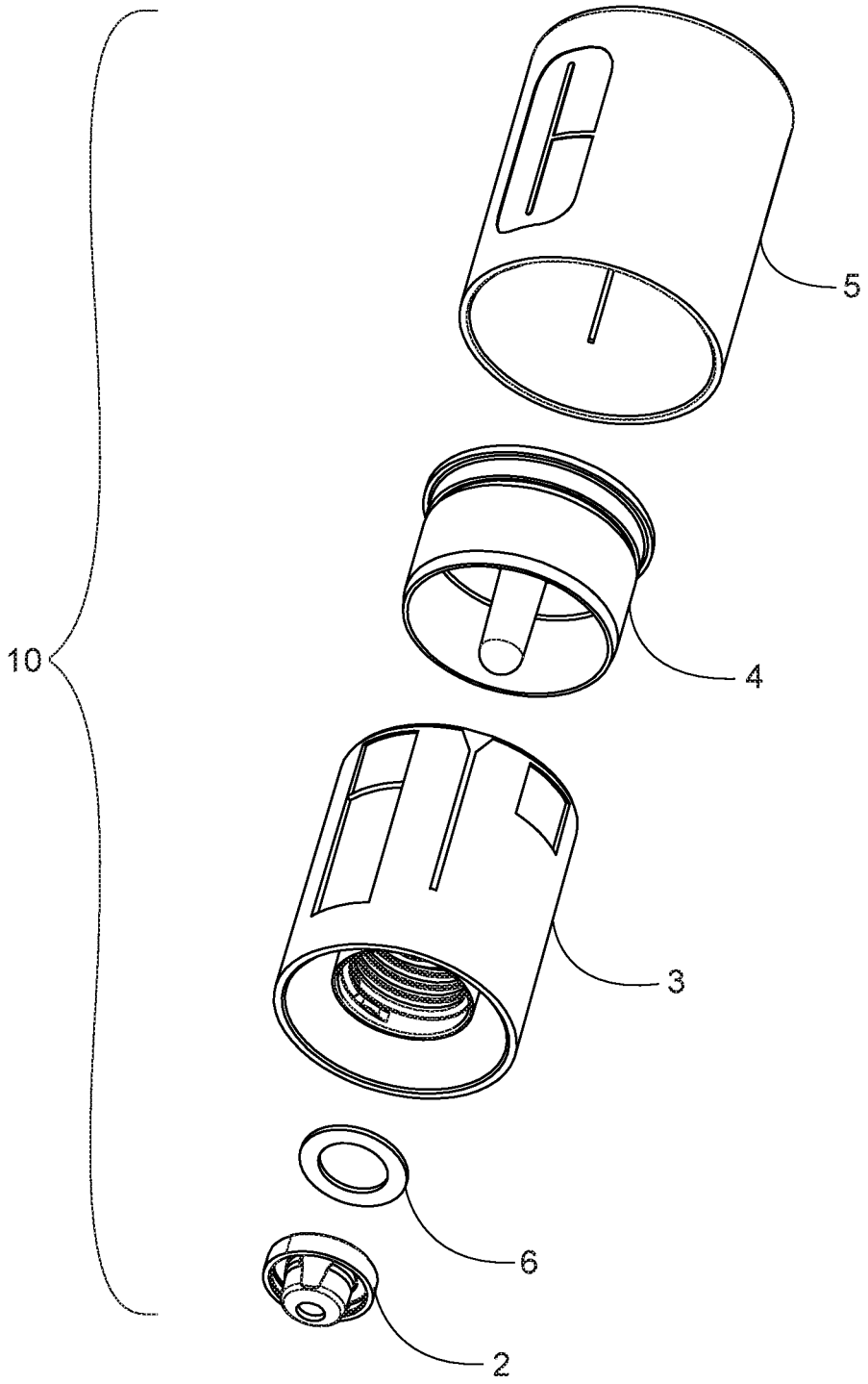
FIG. 2 is an exploded view of a closure assembly according to the invention.

The present invention maintains two products separately until the time of first use. The term "product" may refer to a composition comprising a multiplicity of ingredients, or it may refer to a single ingredient. For example, it may be desirable to maintain an active ingredient separate from the main composition until just prior to first use, in order to preserve the activity of the ingredient. Various types of personal care products may find use with the present invention. However, before mixing, at least one of the products should be flowable, and after mixing, the combined products should also be flowable. For example, either product may be a readily flowable liquid or flowable granulated solid (such as a powder). It is not a requirement that the products possess any degree of mutual solubility, however, it is preferable if one product is at least partially soluble in the other, and more preferable if the two products can achieve complete miscibility with simple shaking. Referring to FIGS. 1 and 2, a container-closure system according to the present invention comprises a container (1), an orifice reducer (2), an inner cap (3), a plug (4), and an overcap (5).

Figure 3:
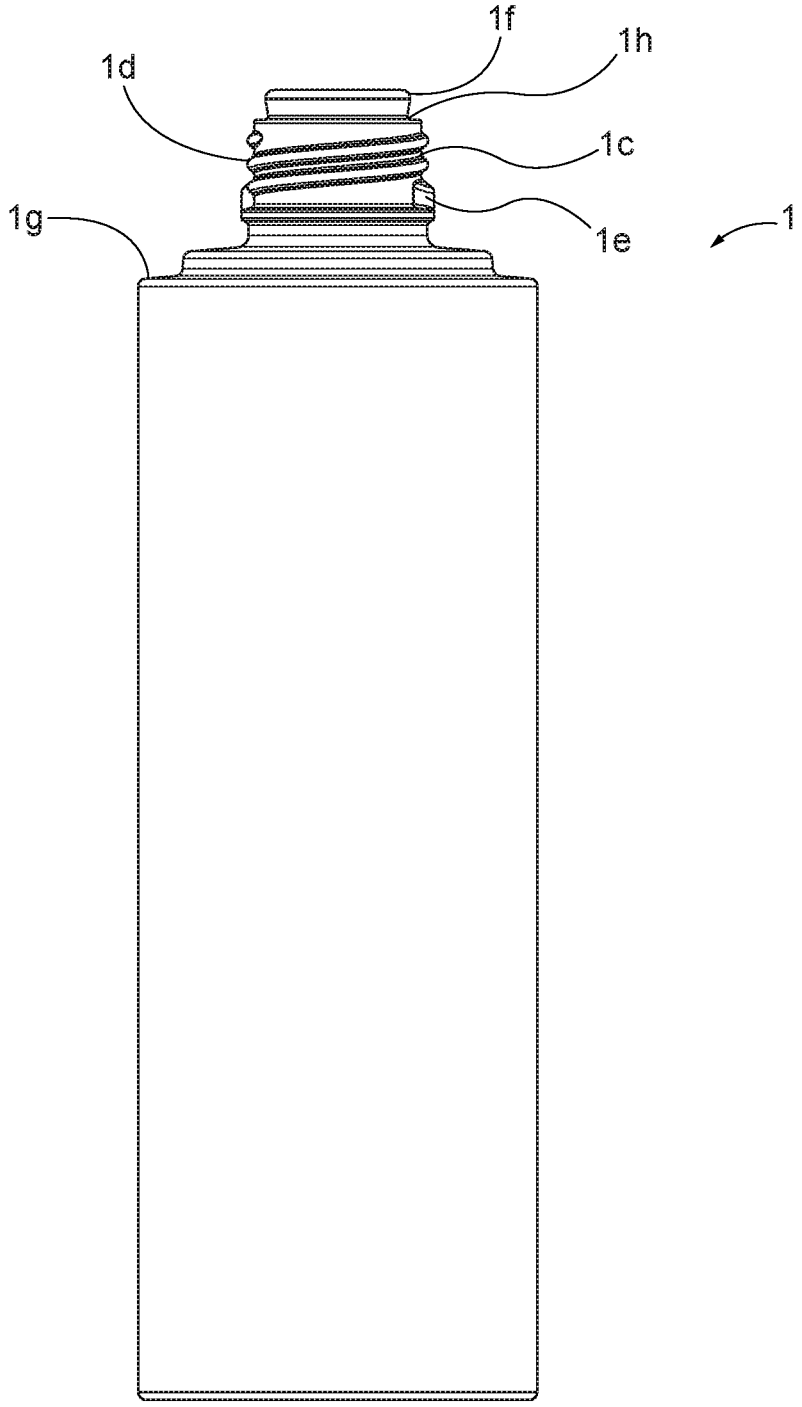
FIG. 3 is an elevation view of a container useful in the present invention.

A container useful in the present invention may be an ordinary threaded-neck container of the type typically used in consumer goods packaging, such as that shown in FIGS. 1 and 3. For example, the container (1) comprises a wall (1*a*) that defines a first reservoir (1*b*) that is able to house a first flowable product (P1). The first flowable product flows into and out of the first reservoir through a neck (1*c*) of the container. The outer surface of the neck comprises screw threads (1*d*) for attaching the inner cap (3). While one thread is sufficient for the operation of the invention, FIG. 3 shows optional dual threads, which enable the inner cap to be fully seated in fewer turns. Optionally, a hard stop (le) may be located at the end of each thread. When the inner cap is fully torqued down, the hard stop provides an audible click, and a more prestigious feel. Below the threads, the container is formed with a shoulder (1*g*). Above the threads, the top surface (1*f*) of the neck may be formed with a groove (1*h*). Typically, the container may be glass or plastic.

Figure 4:
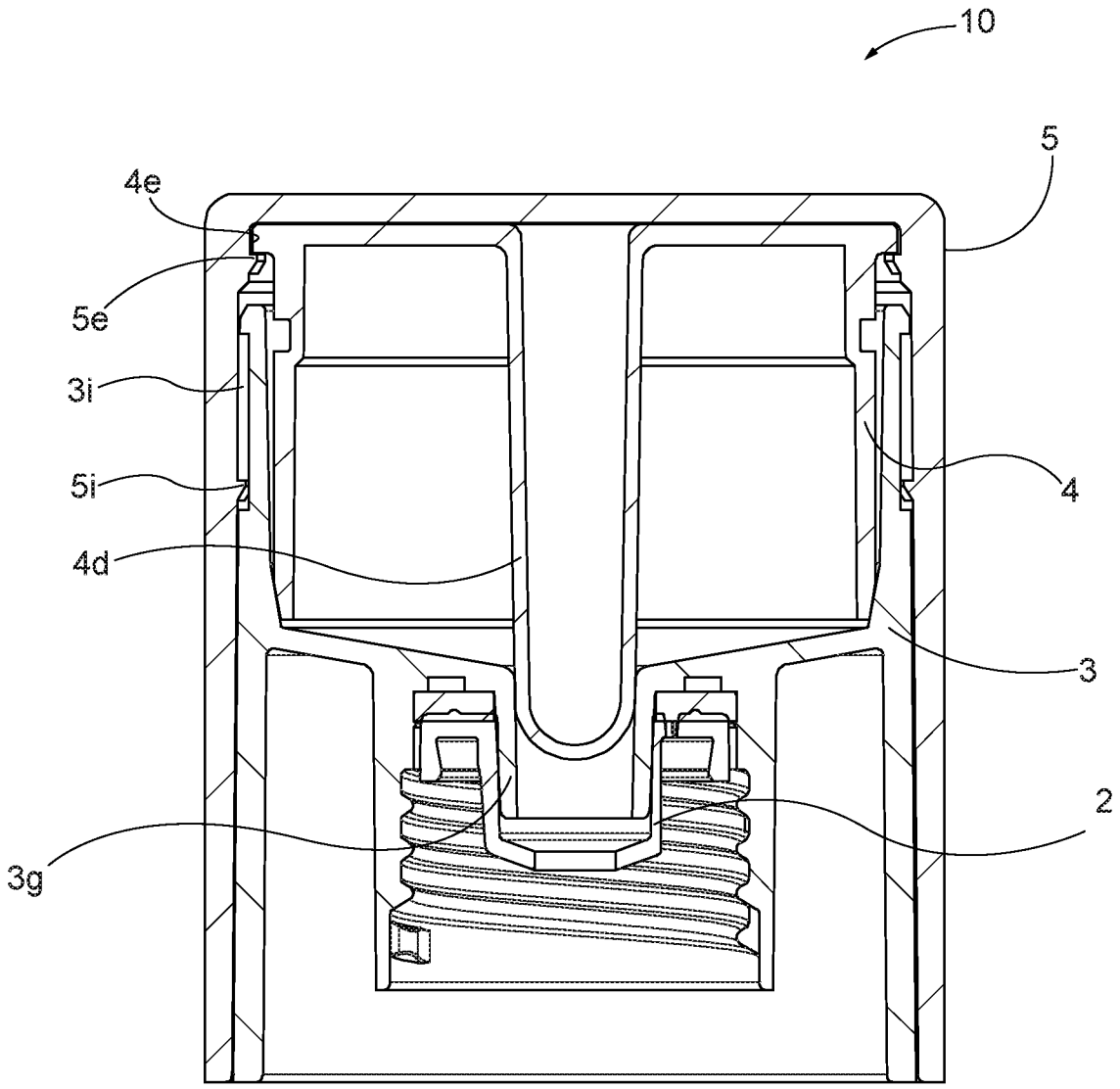
FIG. 4 is a cross sectional view of a closure assembly according to the invention.
Figure 5:
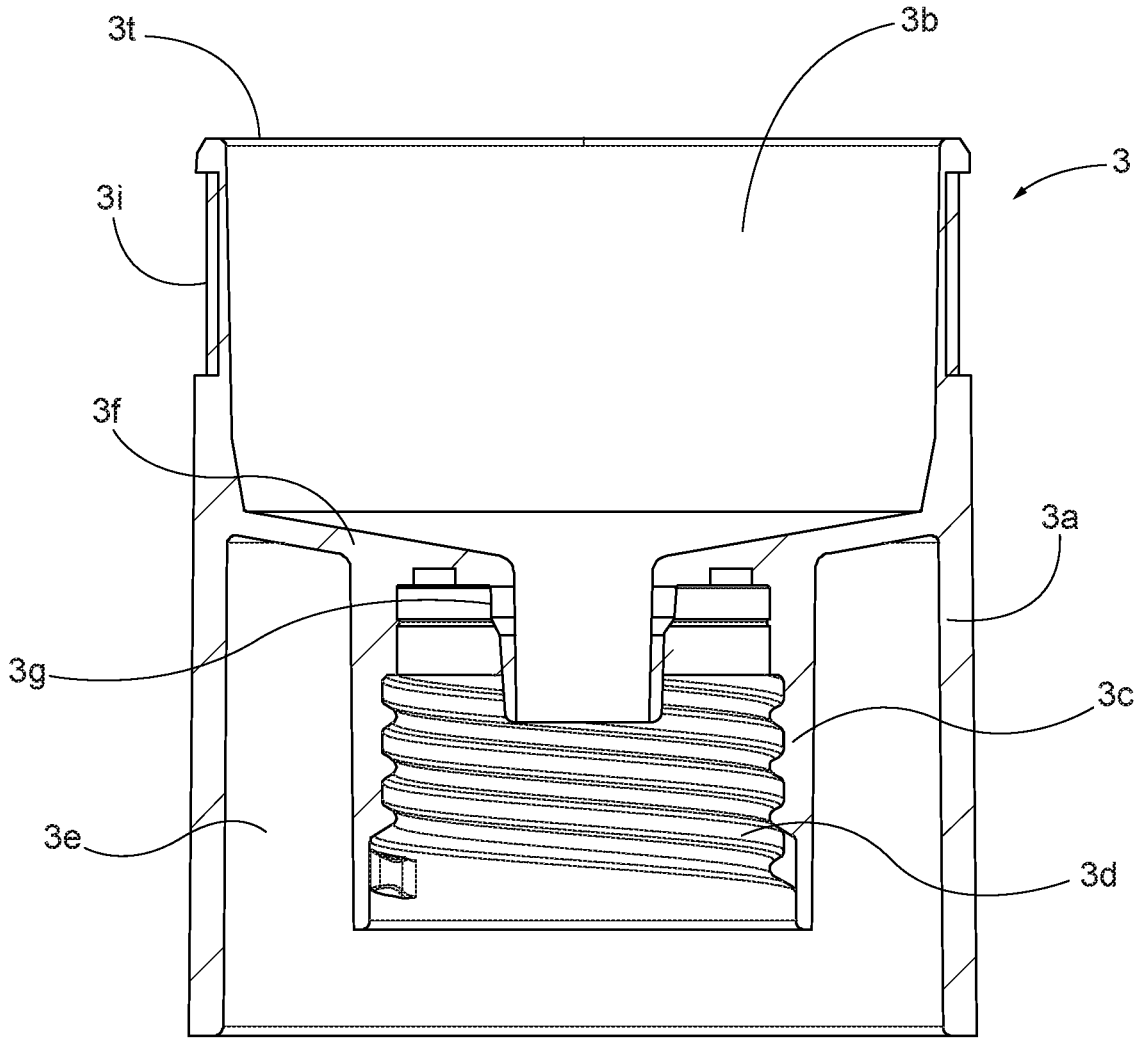
FIG. 5 is a cross sectional view of an inner cap.
Figure 6:
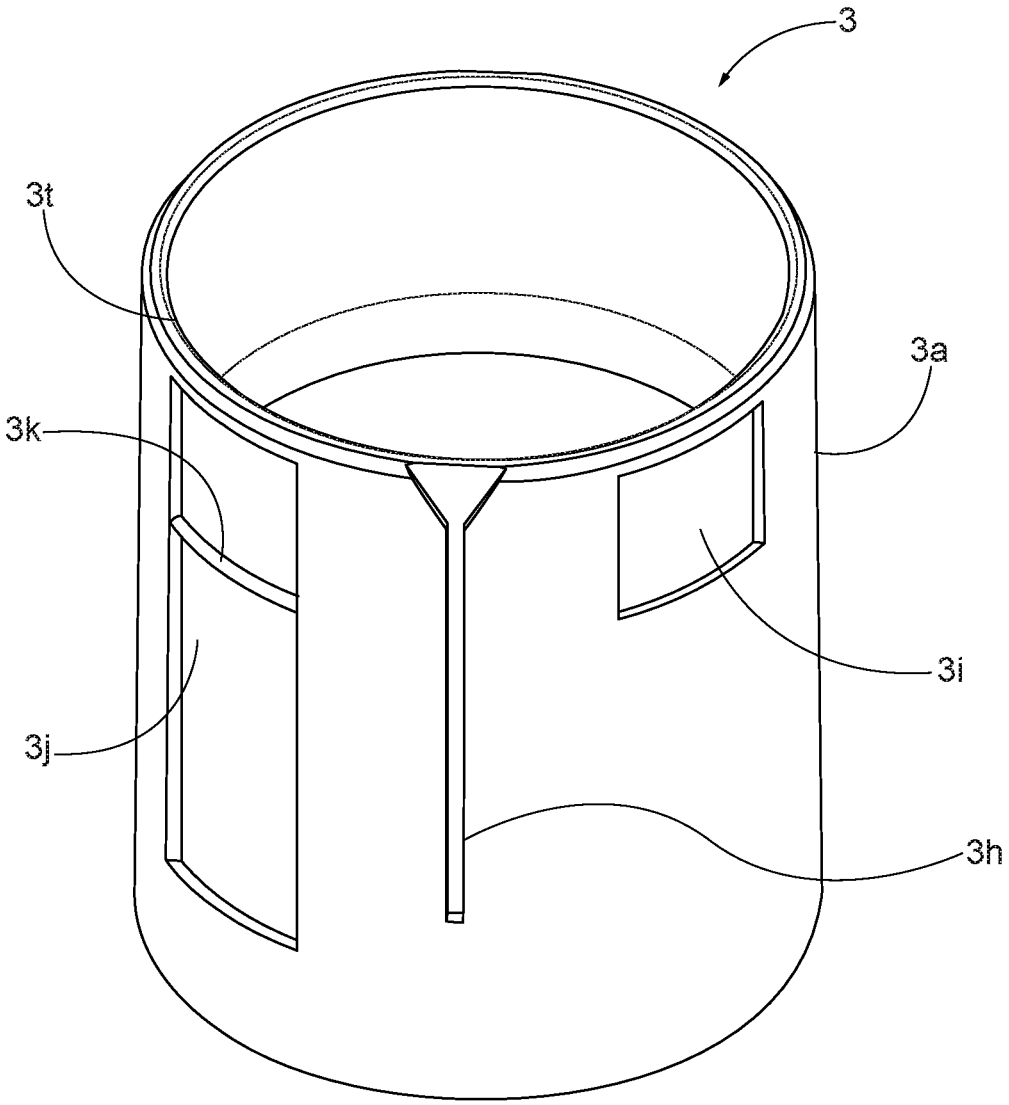
FIG. 6 is a perspective view of an inner cap.

The closure assembly (10) of the present invention may be ordinary in external appearance. However, as shown in FIGS. 2 and 4, the closure assembly (10) that we describe comprises an orifice reducer (2), an inner cap (3), a plug (4) and an overcap (5), wherein the overcap and plug are able to move as one with respect to the inner cap. Referring to FIGS. 5 and 6, the inner cap (3) comprises a vertical wall (3*a*) that defines an interior space. A transverse partition (3*f*) divides the interior space into an upper section (3*b*) and a lower section (3*e*). The upper section (3*b*) functions as a second reservoir that is able to house a second flowable product (P2). Depending from the transverse partition (3*f*), down into the lower section, is a collar (3*c*). The collar comprises threads (3*d*) that cooperate with the one or more threads (1*d*, 1*d*') of the container (1). Also depending from the transverse partition (3*f*) is a hollow stem (3*g*) that is opened at both ends. The stem is located inside the collar, and is concentric with the collar.

Figure 7:
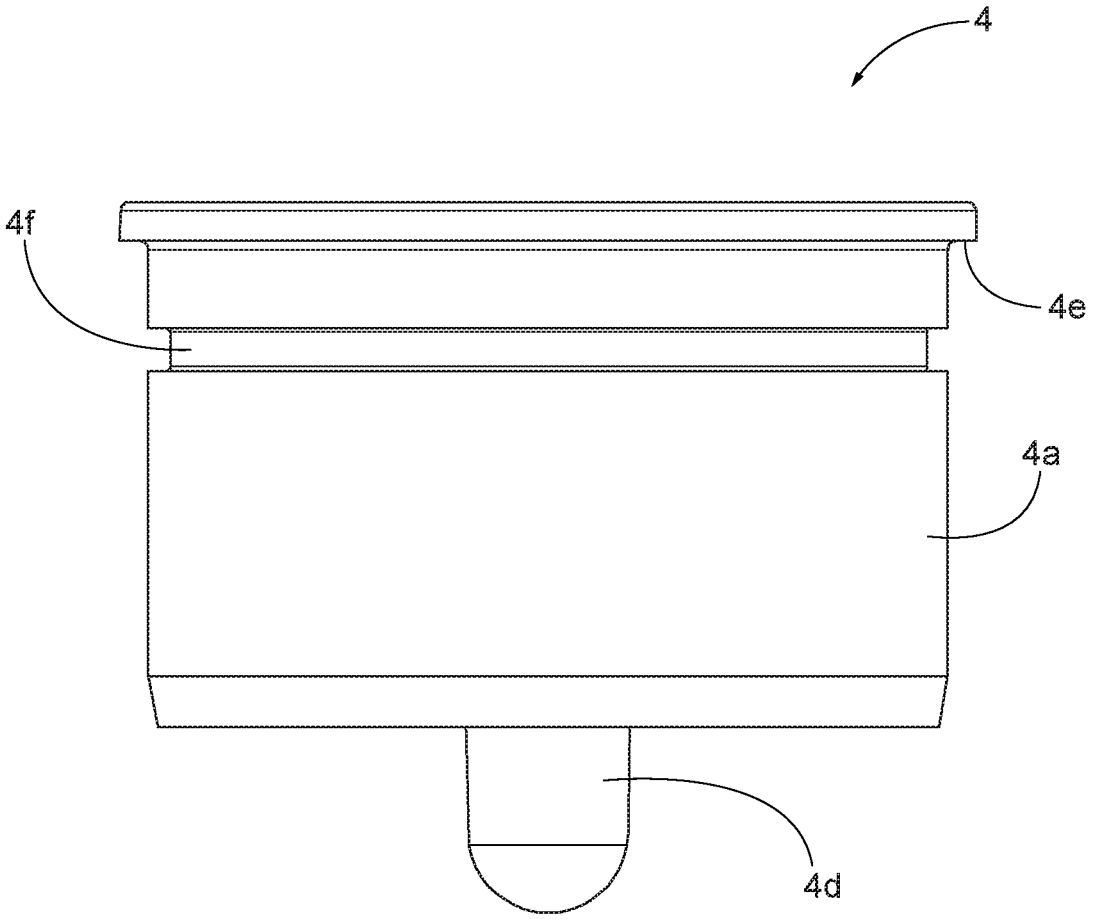
FIG. 7 is an elevation view of a plug.
Figure 8:
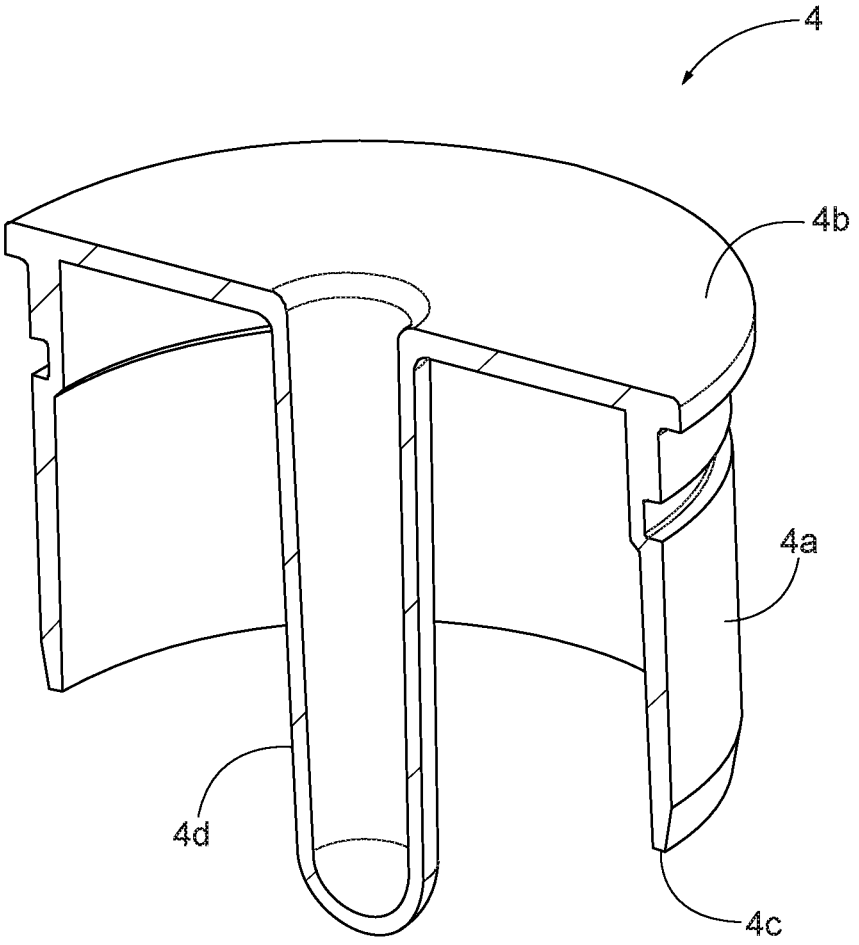
FIG. 8 is a cross sectional view of the plug of FIG. 7.
Figure 9:
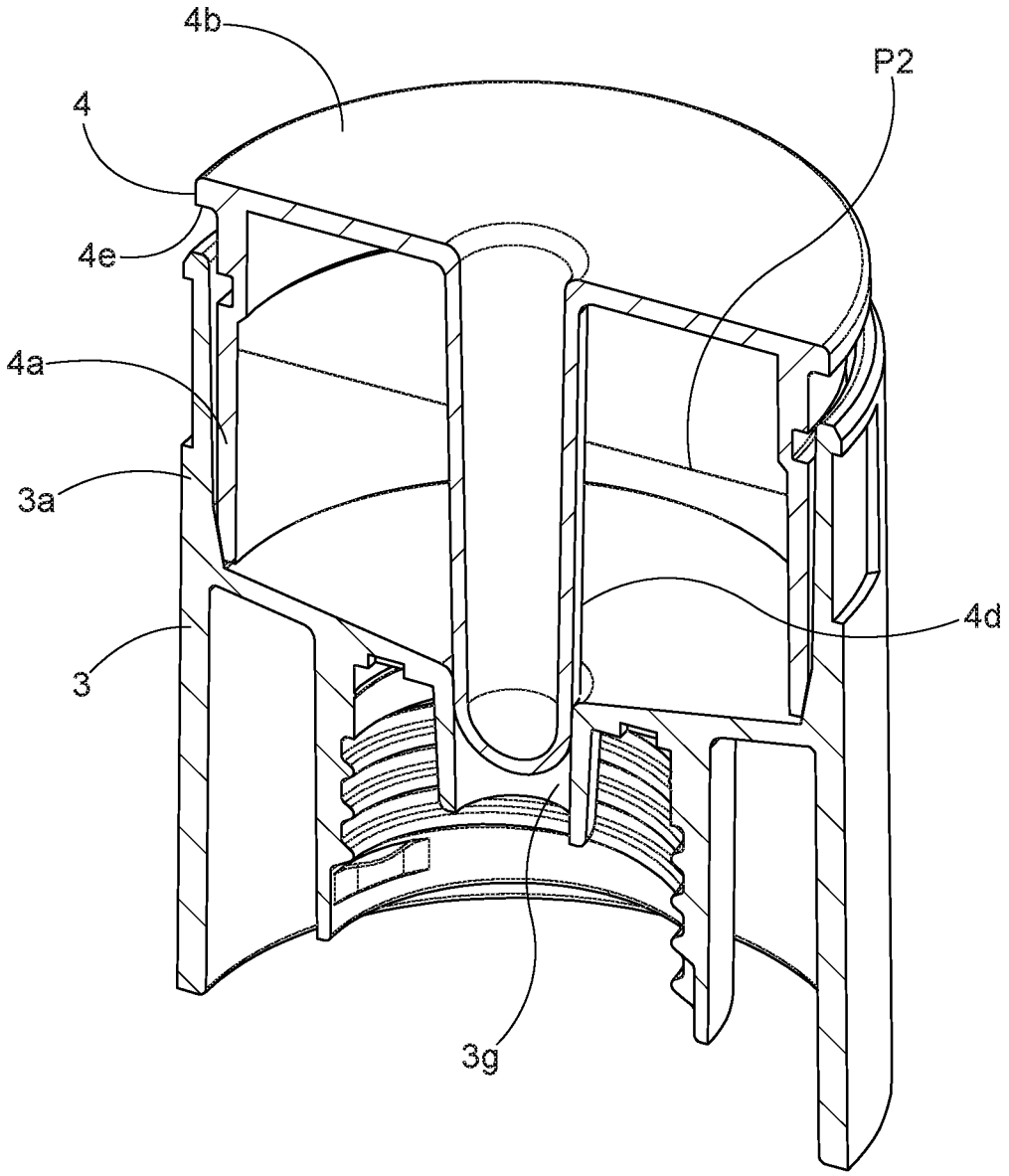
FIG. 9 shows the plug in relation to the inner cap.

The plug (4) is depicted in FIGS. 7 and 8. The plug comprises a cylindrical side wall (4*a*), a closed top (4*b*) and an opened bottom (4*c*). Depending downward from the center of the closed top is a pintel (4*d*). Referring to FIG. 9, the cylindrical side wall (4*a*) of the plug is designed to fit snugly into the vertical wall (3*a*) of the inner cap (3), so as to allow the plug to slide up and down therein. Initially, when the plug is fully inserted into the inner cap, the pintel (4*d*) extends into the hollow stem (3*g*), and is sized to effect a liquid-tight seal that prevents the flow of products between the first and second reservoirs (1*b*, 3*b*). Likewise, a portion of the cylindrical side wall (4*a*) of the plug makes a liquid tight seal against the interior surface of the vertical wall (3*a*) of the inner cap. Optionally, a groove (4*f*) in the cylindrical side wall (4*a*) of the plug (4) may hold an gasket O-ring (not shown) that forms a liquid tight seal against the interior surface of the vertical wall (3*a*) of the inner cap. In this way, the second flowable product (P2) is trapped in the second reservoir of the inner cap, and not allowed to fall into the first reservoir (1*b*) of the container (1).

Figure 10:
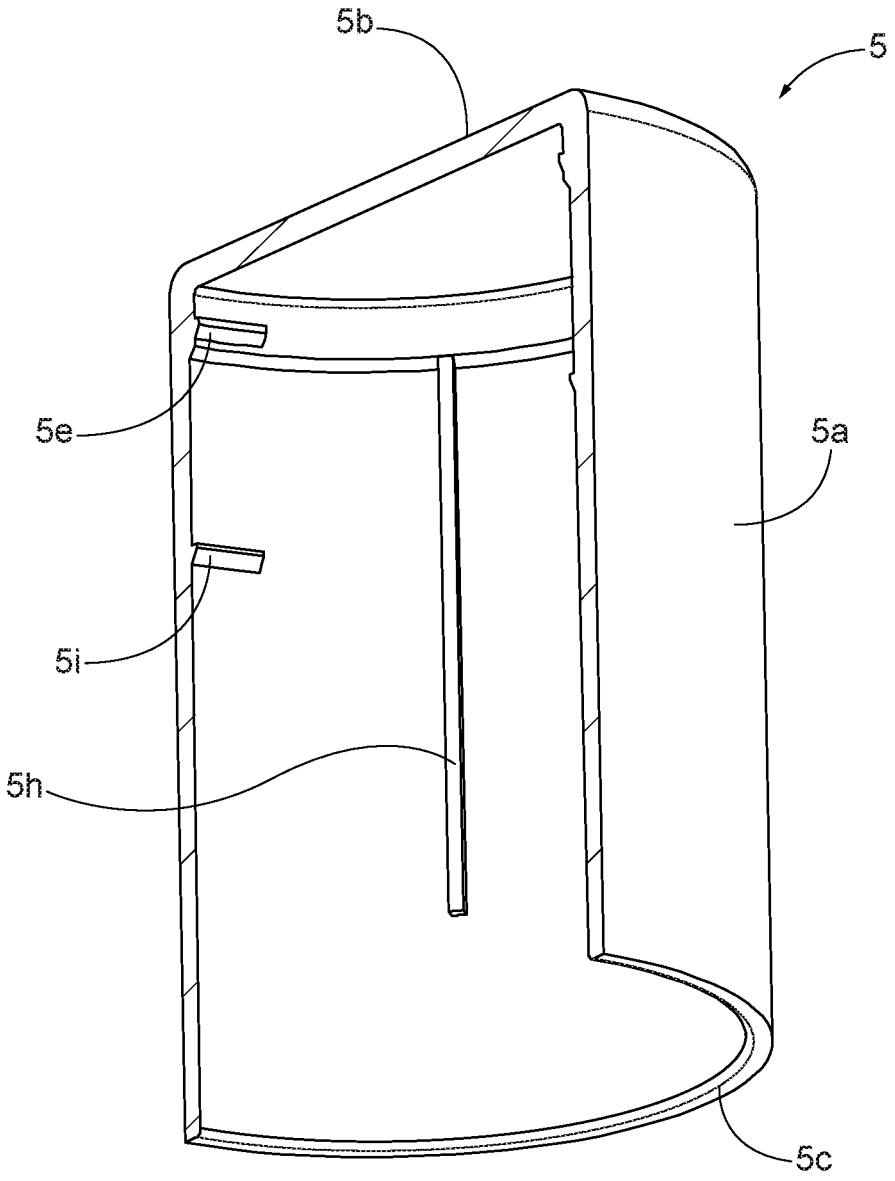
FIG. 10 is a cross sectional view of an overcap.

The overcap (5) houses the plug (4) and inner cap (3). Referring to FIGS. 4 and 10, the overcap (5) comprises a cylindrical wall (5*a*), a closed top (5*b*) and an opened bottom (5*c*). When the plug is fully inserted into the overcap through the opened bottom (5*c*), then the overcap and plug are rigidly connected, so that they move as one. For example, the plug may be provided with a lip (4*e*) that extends outwardly from the closed top (4*b*) of the plug, and the inner surface of the cylindrical wall of the overcap may be provided with one or more upper ledges (5*e*) located near the top of the overcap. In this way, when the plug is fully inserted into the overcap (see FIG. 4), then the lip (4*e*) of the plug is forced over the upper ledges of the overcap, thus securing the plug in the overcap so that they will move as one.

In contrast, the overcap (5) is able to translate up and down relative to the inner cap (3). The vertical movement of the overcap occurs between a lower position and an upper position. Preferably, the overcap is prevented from being completely separated from the inner cap. For example, FIG. 6 shows that the inner cap may be provided with at least one enclosed vertical depression (3*i*) that extends down the exterior surface of the vertical wall (3*a*) of the inner cap, and that does not open up onto the top (3*t*) of the inner cap. Preferably, the inner cap has at least two enclosed vertical depressions of this type symmetrically arranged around the inner cap. In cooperation with this, the inner surface of the cylindrical wall of the overcap (5) may be provided with one or more lower ledges (5*i*) that are located further down the wall from the upper ledges (5*e*) (see FIG. 10). When the inner cap is assembled into the overcap (as shown in FIG. 4), then a lower ledge (5*i*) of the overcap is confined within each enclosed vertical depression (3*i*). The top and bottom of the enclosed vertical depressions define the limits of vertical movement of the overcap with respect to the inner cap.

Preferably, the closure assembly (10) is provided with one or more venting features. For example, FIG. 6 shows that the inner cap may be provided with at least one open vertical depression (3*j*) that extends down the exterior surface of the vertical wall (3*a*) of the inner cap, and that opens up onto the top (3*t*) of the inner cap. In operation, when the overcap is raised relative to the inner cap, the open vertical depressions will allow air into the expanding space to prevent a vacuum from forming, which would hinder function.

In order to prevent leakage during distribution, it may be preferable to prevent accidental movement of the overcap (5) and plug with respect to the inner cap (3). To this end, the exterior surface of the vertical wall (3*a*) of the inner cap may be provided with one or more bumps (3*k*) which are intended to engage one or more of the lower ledges (5*i*) of the overcap, as follows. When the inner cap and overcap are fully assembled, one or more lower ledges (5*i*) of the overcap are forced into position just below one or more bumps (3*k*) of the inner cap. This obstruction can be intentionally overcome by apply sufficient force by hand, but accidental movement during distribution will be prevented.

Referring to FIGS. 6 and 10, the inner cap (3) and over cap (5) may be provided with features that prevent relative rotation between the two. For example, the inner cap (3) may comprise at least one vertical track (3*h*) that extends longitudinally down the exterior surface of the vertical wall (3*a*) of the inner cap. Furthermore, the overcap may comprise at least one vertical shaft (5*h*) that extends longitudinally down the inner surface of the vertical wall (5*a*) of the over cap. When the inner cap is assembled into the overcap, then each vertical shaft (5*h*) of the overcap slides within a vertical track (3*h*) of the inner cap, and the overcap is prevented from rotating relative to the inner cap. Optionally, the vertical track (3*h*) may open up onto the top (3*t*) of the inner cap. This would make assembly of inner cap into overcap easier.

Figure 11:
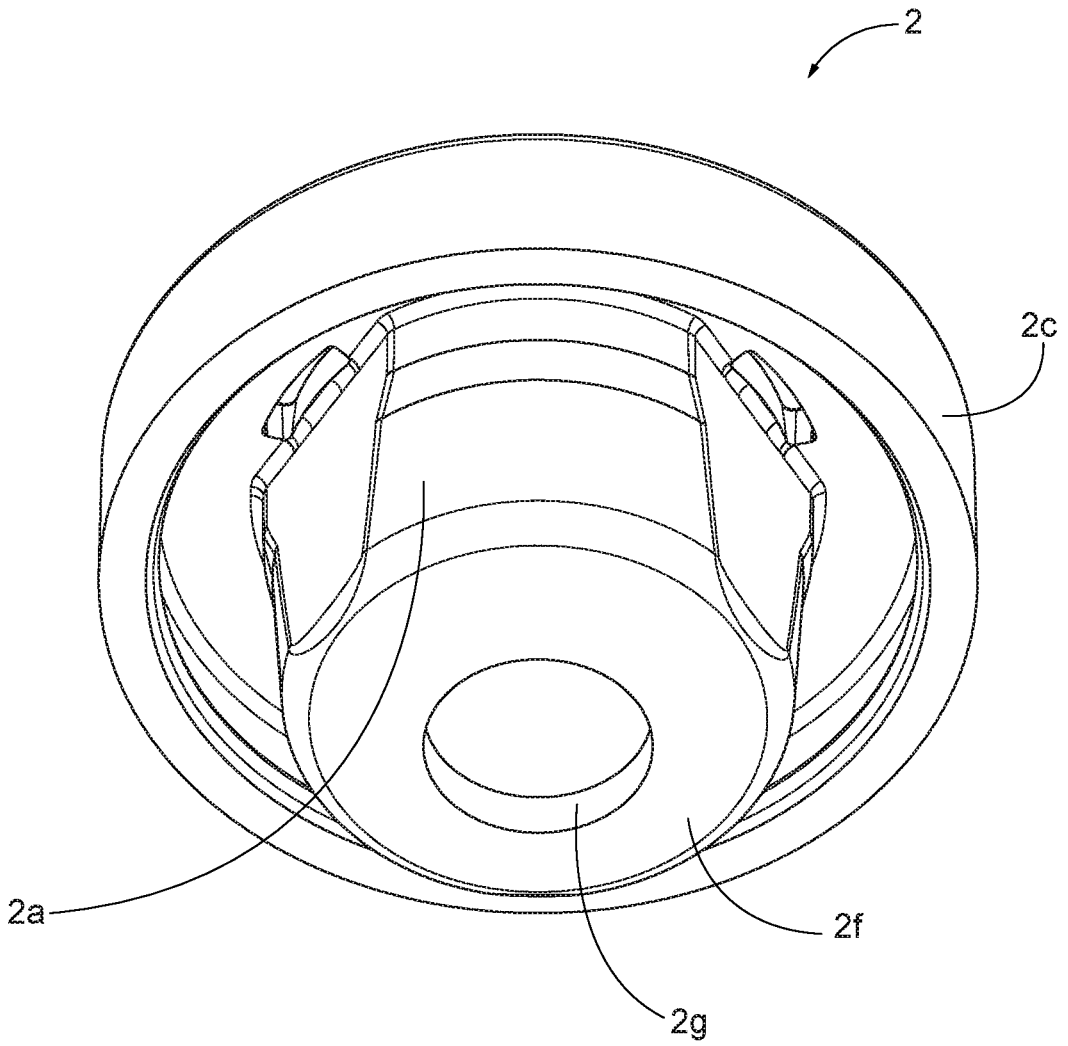
FIG. 11 is a perspective view of an orifice reducer.
Figure 12:
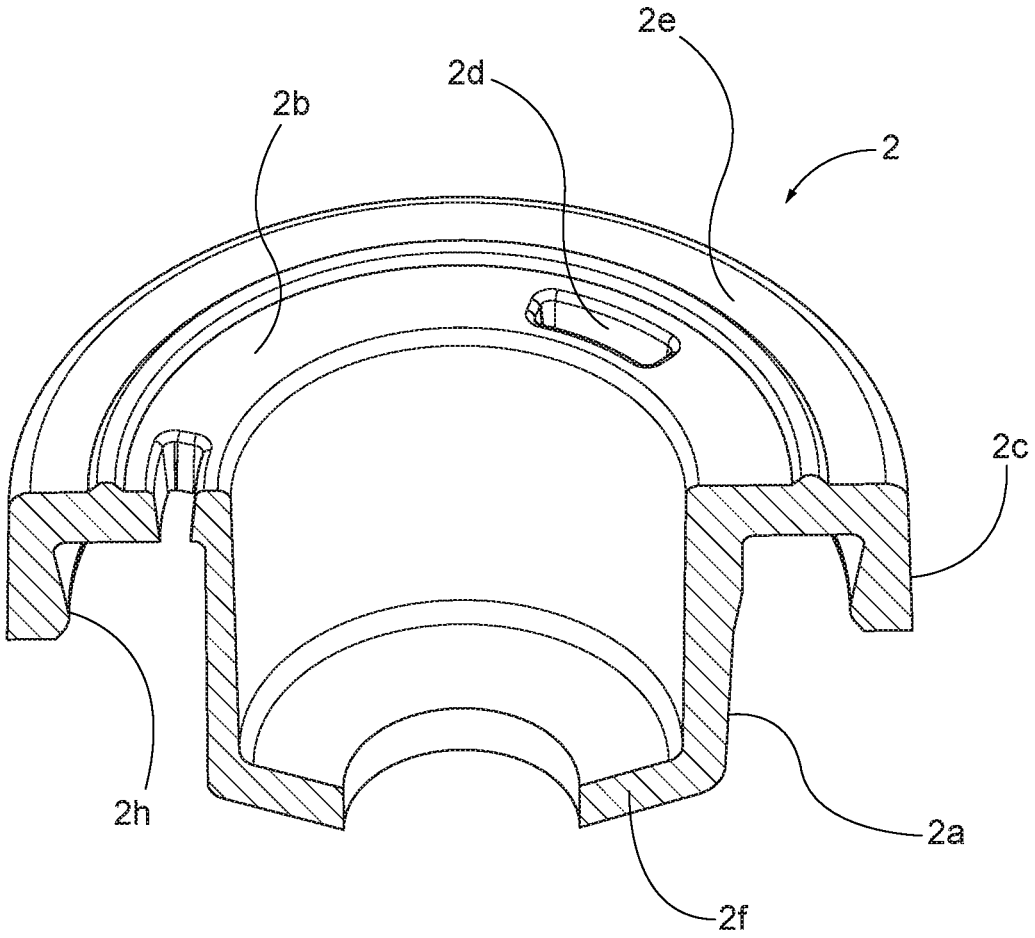
FIG. 12 is a cross sectional view of the orifice reducer of FIG. 11.

FIGS. 11 and 12 depict one embodiment of an orifice reducer (2). In general, the orifice reducer comprises a hollow cylindrical body (2*a*) that has a top a bottom. A flange (2*b*) surrounds the top of the body, extending radially outward, and a skirt (2*c*) depends downwardly from the flange. One or more vents (2*d*) pass through the flange. The bottom of the skirt may be formed as an enlarged portion (2*h*) for gripping the neck (1*c*) of the container (1). A base (2*f*) extends radially inward from the bottom of the body, and defines an orifice (2*g*).

Figure 13:
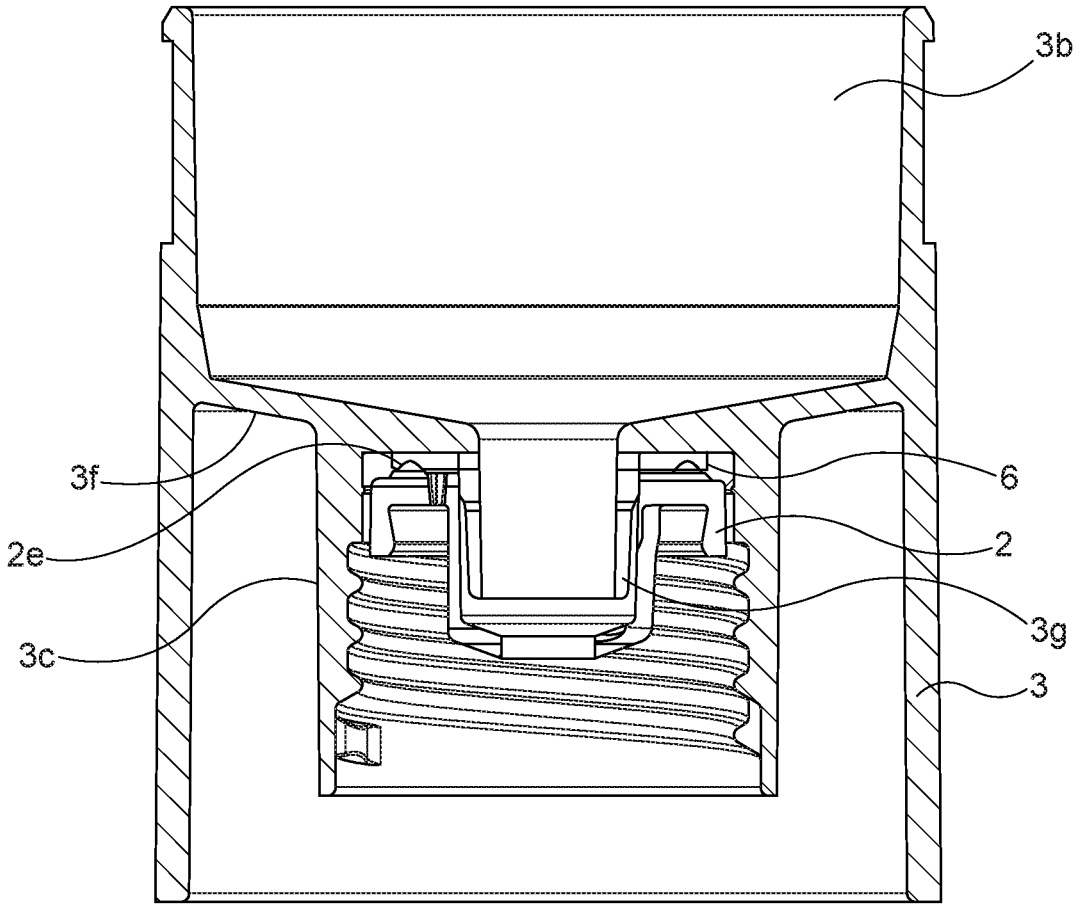
FIG. 13 shows the orifice reducer in relation to the inner cap.

Referring to FIG. 13, the orifice reducer (2) is initially associated with the inner cap (3). The orifice reducer is secured in the inner cap, being friction fitted between the collar (3*c*) and the stem (3*g*). Optionally, an O-ring liner (6) may be positioned between the transverse partition (3*f*) of the inner cap and the flange (2*b*) of the orifice reducer. Optionally, a sealing bead (2*e*) may rise from the flange of the orifice reducer, to make a more effective seal with the O-ring liner.

Figure 14:
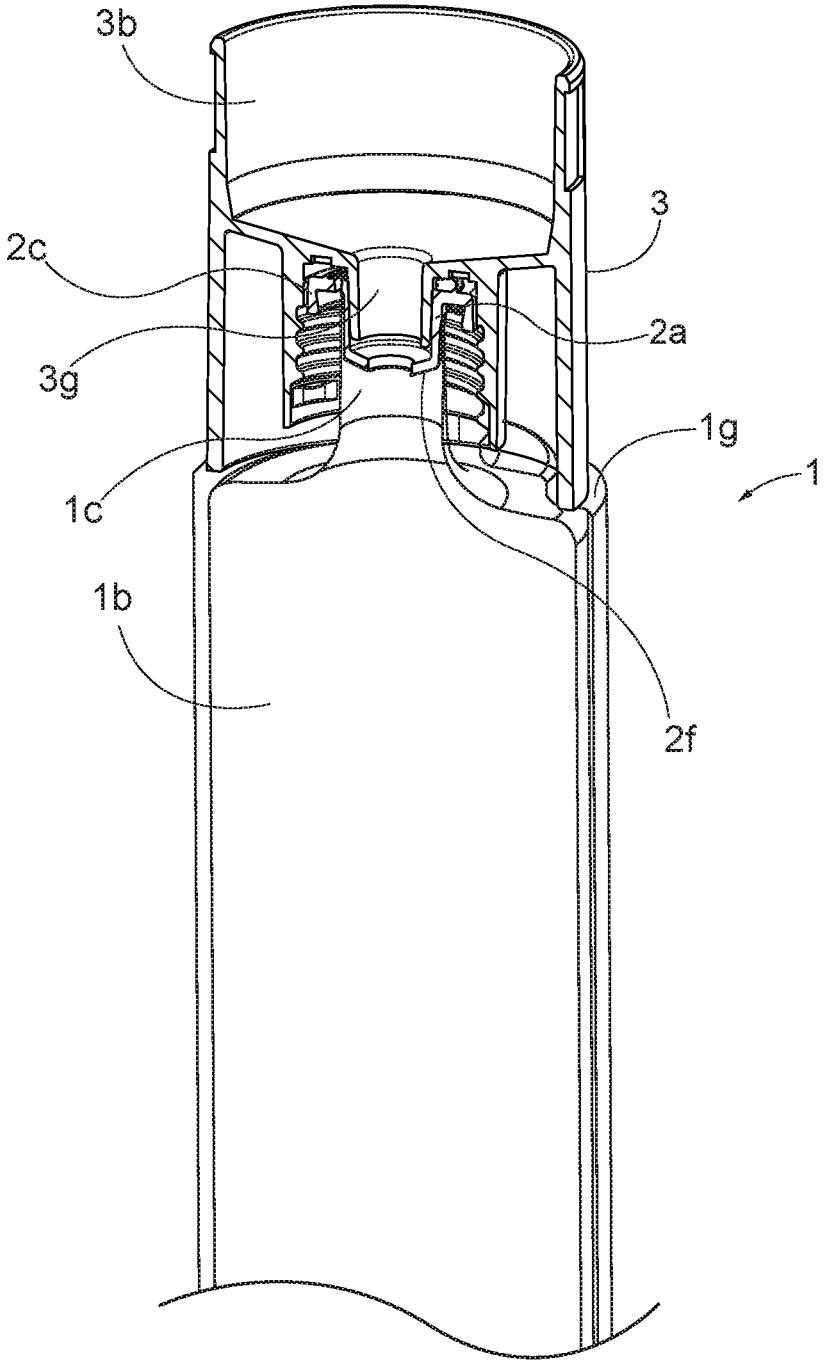
FIG. 14 shows the inner cap and orifice reducer in relation to the container.

The first time that the inner cap (3) with orifice reducer (2) is fully seated on the container (1), the skirt (2*c*) of the orifice reducer will be stretched over the neck (1*c*) of the container (as shown in FIG. 14). Displaced air from within the neck of the container will escape through the one or more vents (2*d*) of the flange (2*b*). Thereafter, the orifice reducer will remain attached to the neck of the container, even when the inner cap is unscrewed from the container. The attachment of the orifice reducer to the container may be facilitated by the enlarged portion (2*h*) of the skirt engaging the groove (1*h*) on the neck of the container. In the process, a liquid tight connection is formed between the orifice reducer and the neck of the container. In order to ensure a liquid tight connection between the orifice reducer and the neck of the container, the vertical wall (3*a*) of the inner cap and the vertical wall (5*a*) of the overcap (5) must not bottom out on the shoulder (1*g*) of the container before the orifice reducer is fully seated onto the neck.

As shown in FIG. 14, when the inner cap (3) with orifice reducer (2) is fully seated on the container (1), then the hollow stem (3*g*) of the inner cap and the cylindrical body (2*a*) of the orifice reducer are positioned in the neck (1*c*) of the container. The hollow stem and orifice reducer form a passageway between the first reservoir (1*b*) and second reservoir (3*b*), through which the first and second flowable products (P1, P2) can sometimes pass. However, when the overcap (5) and plug (4) are at their lowest position with respect to the inner cap, then the pintel (4*d*) of the plug extends into the hollow stem (3*g*) of the inner cap (see FIG. 4). The pintel and hollow stem are sized to effect a liquid-tight seal that closes the passageway between the first and second reservoirs (1*b*, 3*b*).

Assembly and Filling

The plug (4) is first assembled into the overcap (5), such that the lip (4*e*) of the plug is forced over the upper ledges (5*e*) of the overcap, thus making a rigid connection between the plug and the overcap, so that they will move as one. With the plug and overcap upside down, a second flowable product (P2) is filled to the plug.

Next, the orifice reducer (2) and O-ring liner (6) are assembled into the inner cap, as explained above. The inner cap (3) then assembled into the overcap, so that some of the lower ledges (5*i*) of the overcap are confined within one or more vertical depressions (3*i*) of the inner cap, and some other lower ledges (5*i*) of the overcap are forced into position just below one or more bumps (3*k*) of the inner cap. Also, each vertical shaft (5*h*) of the overcap slides within a vertical track (3*h*) of the inner cap, which prevents to overcap from rotating relative to the inner cap.

At this point, the pintel (4*d*) of the plug extends into the hollow stem (3*g*) of the inner cap, and forms a liquid tight seal. Likewise, a portion of the cylindrical side wall (4*a*) of the plug makes a liquid tight seal against the interior surface of the vertical wall (3*a*) of the inner cap. In this way, the second flowable product (P2) is trapped in the second reservoir (3*b*) of the inner cap. The overcap, plug and inner cap with orifice reducer form a complete closure assembly (10) that is filled with the second flowable product (P2). Also, accidental movement of the overcap (5) and plug (4) with respect to the inner cap (3) is not possible. Therefore, the closure assembly may now be turned upright without fear of leakage.

The first reservoir (1*b*) of the container (1) is filled with a first flowable product (P1). This is done through the neck (1*c*) of the container, before the orifice reducer is attached to the neck. It is critical to leave enough headspace in the first reservoir for at least a portion of the second flowable product (P2).

Next, the closure assembly (10) is applied to the container (1) by screwing the inner cap (3) onto the container until tight. In the process, the skirt (2*c*) of the orifice reducer will be stretched over the neck (1*c*) of the container, and thereafter, the orifice reducer will remain attached to the neck of the container. At this point, the first flowable product is in the first reservoir (1*b*), and the second flowable product is in the second reservoir (3*b*). The container-closure system, which appears to be an ordinary bottle of product, is ready for distribution.

Consumer Use

When consumer wants to use a fully assembled container-closure system of the present invention, the overcap (5) is raised to its upper position by pulling the overcap and container (1) in opposite directions. Initially, sufficient force must be applied by hand to urge one or more lower ledges (5*i*) of the overcap over one or more bumps (3*k*) of the inner cap, but after that, sliding the overcap relative to the inner cap is easy. When this is done, the plug (4) slides upward relative to the inner cap (3), the seal between the pintel (4*d*) and the hollow stem (3*g*) is broken, the passageway between the first reservoir and second reservoir is opened, and the second flowable product (P2) will pass through the passageway, into the first reservoir (1*b*), thus mixing the first and second flowable products. The user waits a short time for the second flowable product to pass into the first reservoir. Once all of the second flowable product has drained into the first reservoir, the overcap may be returned to its lower position with respect to the inner cap. After the first time, raising and lowering the overcap and plug will have no effect.

Optionally, the consumer may shake the container-closure system to thoroughly mix the two products.

Thereafter, a twisting force applied to the overcap (5) will unscrew the inner cap off of the container (1), leaving the orifice reducer (2) attached to the container.

The consumer dispenses the mixed products by pouring through the orifice reducer.

When finished, the closure assembly (10) is again screwed onto the container (1).

What is claimed is:

1. A container-closure system that comprises:

a threaded-neck container that defines a first reservoir;

a closure assembly that comprises an inner cap, a plug, an overcap, and an orifice reducer, wherein:

the inner cap comprises:

a vertical wall that defines an interior space, the interior space is divided into an upper section and a lower section by a transverse partition, wherein the upper section functions as a second reservoir;

a collar that depends from the transverse partition, down into the lower section, and comprises threads that cooperate with the threaded neck of the container; and a hollow stem that depends from the transverse partition of the inner cap, and is concentric with the collar and located inside the collar;

the plug comprises:

a cylindrical side wall that fits snugly into the vertical wall of the inner cap, so as to allow the plug to slide up and down therein, while also forming a liquid tight seal between the cylindrical side wall and the vertical wall of the inner cap;

a closed top;

an opened bottom, and a pintel that depends downward from the center of the closed top;

the overcap comprises:

a cylindrical wall, a closed top, and an opened bottom; wherein the plug and inner cap are received into the opened bottom of the overcap;

the overcap is able to translate up and down relative to the inner cap between a lower position and an upper position; and the plug is rigidly connected to the overcap and moves with the overcap;

the orifice reducer is secured between the collar and the stem of the inner cap, and comprises:

a cylindrical body;

a flange the extends radially outward, one or more vents that pass through the flange, and a skirt that depends downward from the flange;

such that, when the inner cap is fully seated on the container, then:

the skirt of the orifice reducer is stretched over the neck of the container to form a liquid tight connection between the orifice reducer and the neck of the container; and the hollow stem of the inner cap and the cylindrical body orifice reducer form a passageway between the first and second reservoirs;

such that, when the overcap is in the lower position relative to the inner cap, then the pintel extends into the hollow stem of the inner cap, and forms a liquid-tight seal to close off the passageway between the first and second reservoirs; and such that, when the overcap is in the upper position relative to the inner cap, then the seal between the pintel and the hollow stem is broken, and the passageway between the first and second reservoirs is opened.

2. The container-closure system of claim 1, when the overcap is in the lower position relative to the inner cap, and a first flowable product is housed in the first reservoir, and a second flowable product is housed in the second reservoir.

3. The container-closure system of claim 1, wherein the top surface of the neck of the container comprises a groove, and the skirt of the orifice reducer comprises enlarged portion that engages the groove of the neck.

4. The container-closure system of claim 1, wherein the rigid connection of the plug and overcap is effected by a lip that extends outwardly from the closed top of the plug, and one or more upper ledges that are located on an inner surface of the overcap.

5. The container-closure system of claim 1, wherein:

the vertical wall of the inner cap has a top and an exterior surface, and is provided with at least one enclosed vertical depression that extends down the exterior surface, and that does not open up onto the top of the vertical wall; and the cylindrical wall of the overcap has an inner surface that is provided with one or more lower ledges that are confined within each enclosed vertical depression.

6. The container-closure system of claim 1 further comprising at least one venting feature, wherein:

the vertical wall of the inner cap has a top and an exterior surface, and is provided with at least one open vertical depression that extends down the exterior surface of the vertical wall, and that opens up onto the top of the inner cap.

7. The container-closure system of claim 1, wherein:

the vertical wall of the inner cap has an exterior surface, and is provided with at least one bump the cylindrical wall of the overcap has an inner surface that is provided with one or more lower ledges that are positioned just below the one or more bumps of the inner cap, to prevent accidental movement of the overcap and plug with respect to the inner cap.

8. The container-closure system of claim 1, wherein:

the vertical wall of the inner cap has an exterior surface, and is provided with at least one open vertical track that extends longitudinally down the exterior surface of the vertical wall of the inner cap; and the cylindrical wall of the overcap has an inner surface that is provided with at least one vertical shaft that extends longitudinally down the inner surface of the vertical wall of the over cap; such that each vertical shaft of the overcap slides within a vertical track of the inner cap, to prevent the overcap from rotating relative to the inner cap.

9. The container-closure system of claim 1, wherein:

an O-ring liner is positioned between the transverse partition of the inner cap and the flange of the orifice reducer; and the orifice reducer comprises a sealing bead that rises from the flange to make an effective seal with the O-ring liner.

10. A method of filling the container-closure system of claim 1, comprising the steps of:

a. assembling the plug into the overcap by a rigid connection, so that the plug and overcap will move as one;

b. with the plug and overcap upside down, filling the plug with a second flowable product;

c. assembling the orifice reducer into the inner cap;

d. completing the closure assembly by assembling the inner cap into the overcap so that the pintel of the plug extends into the hollow stem of the inner cap, and forms a liquid tight seal;

e. turning the closure assembly upright;

f. filling the first reservoir of the container with a first flowable product through the neck of the container, leaving enough headspace in the first reservoir for at least a portion of the second flowable product; and g. applying the closure assembly to the container by screwing the inner cap onto the container until tight.

11. A method of using the container-closure system of claim 1, comprising the steps of:

a. raising the overcap to its upper position by pulling the overcap and container in opposite directions;

b. waiting for the second flowable product to pass through the opened passageway, into the first reservoir;

c. optionally, returning the overcap to its lower position;

d. optionally, shaking the container and closure system to thoroughly mix the two products;

e. unscrewing the closure assembly off of the container;

f. dispensing the mixed products by pouring through the orifice reducer; and g. screwing the closure assembly onto the container.

* * * * *